US005791583A

United States Patent [19]

Alexander, III et al.

[11] Patent Number: 5,791,583

[45] Date of Patent: *Aug. 11, 1998

[54] CLOTH TAKEUP CONTROL APPARATUS AND METHOD

[75] Inventors: William J. Alexander, III, Mauldin; Shala W. Summey, III, Greenville; Fred A. Chapman, Simpsonville, all of S.C.

[73] Assignee: Alexander Machinery, Inc., Simpsonville, S.C.

[ * ] Notice: The term of this patent shall not extend beyond the expiration date of Pat. No. 5,299,753.

[21] Appl. No.: 384,418

[22] Filed: Feb. 6, 1995

[51] Int. Cl.[6] ..... B65H 18/10; B65H 18/16; B65H 23/04

[52] U.S. Cl. ..... 242/412.3; 242/413.2; 242/413.5; 242/419.1; 242/541.1

[58] Field of Search ..... 242/412.3, 413.1, 242/413.2, 413.5, 419.1, 419.9, 547, 541.1, 541.6, 334.2, 334.5

[56] References Cited

U.S. PATENT DOCUMENTS

| | | | |
|---|---|---|---|
| 2,943,809 | 7/1960 | Garrett | 242/412.3 |
| 3,115,314 | 12/1963 | Manley et al. | 242/413.2 |
| 3,240,443 | 3/1966 | Nitka | 242/413.2 |
| 3,687,388 | 8/1972 | Pfeiffer | 242/534 |
| 3,730,450 | 5/1973 | Hank | 242/541.1 |
| 3,746,278 | 7/1973 | Dennis et al. | 242/412.3 |
| 3,858,820 | 1/1975 | Crouse | 242/413.5 |
| 3,862,723 | 1/1975 | Bonikowski | 242/413.2 |
| 4,025,009 | 5/1977 | Fineo | 242/413.7 |
| 4,076,184 | 2/1978 | Morgan | 242/419.1 |
| 4,139,166 | 2/1979 | Powell et al. | 242/542.1 |
| 4,166,590 | 9/1979 | Dennhardt | 242/413.2 |
| 4,216,804 | 8/1980 | Alexander et al. | 242/413.5 |
| 4,634,069 | 1/1987 | Kataoka | 242/413.5 |
| 4,854,511 | 8/1989 | Montali et al. | 242/419.1 |
| 5,056,730 | 10/1991 | Buckle | 242/419.9 |
| 5,080,295 | 1/1992 | Hongo et al. | 242/419.9 |

*Primary Examiner*—John M. Jillions
*Attorney, Agent, or Firm*—Ralph Bailey

[57] ABSTRACT

A loom cloth takeup having pivotally mounted arms A exerting a force upon a friction roll (F) has first and second control devices (E) and (H) respectively for controlling tension on the cloth ahead of the friction roll (F) and for controlling a motor (G) driving the friction roll (F) to afford full roll tension control during the build of the cloth roll. A regenerative DC motor drive (H) is provided to avoid slippage between the friction roll and the cloth during winding, and a center wind motor control utilizing a capacitor (I) in series with the motor imparts a negative slope to the speed load characteristic.

9 Claims, 4 Drawing Sheets

CLOTH TAKEUP CONTROL APPARATUS AND METHOD

BACKGROUND OF THE INVENTION

This invention relates to an improvement in the control apparatus and method of U.S. Pat. No. 5,299,753 for maintaining suitable tension in a center wound cloth roll takeup and the like.

The tension applied to the cloth or other web by a friction roll is controlled so as to make possible the production of a tightly wound cloth roll during its full build. Such control, for example, may be especially useful for winding cloth manufactured from fiberglass or carbon yarn and the like.

Heretofore, compensator rolls for controlling tension in a surface wound cloth takeup have been disclosed in U.S. Pat. No. 4,216,804. Cloth takeups having hold down arms and the like for applying tension to cloth by driven friction rolls as it is wound on a center wound roll are illustrated in U.S. Pat. No. 4,139,166. U.S. Pat. No. 4,634,069 illustrates the use of a dancer roll for controlling the drive of a center wound roll as well as a friction roll through a common drive motor. The following U.S. Patents are further illustrative of the state of the art: U.S. Pat. Nos. 4,025,009; 3,858,820; 3,730,450; and 3,687,388. In the winding of tight cloth rolls for certain fabrics, it has been found that center wound rolls are preferable to surface wound takeup rolls. It is also desirable to control and thereby limit the tension exerted upon the fabric from the friction roll, as the cloth is being wound upon the center wound cloth roll, back to the loom. Otherwise, the weaving process may be disrupted due to the application of heavy tension tending to pull the warp yarns and the cloth out of the loom. Hold down rolls such as illustrated in U.S. Pat. No. 4,139,166 have been provided on hold down arms held with a force as exerted by a cylinder provided with adjustable braking means to control tension in the cloth at the point of winding. However, it has not been possible to constantly and uniformly adjust the brake so as to constantly vary the tension exerted upon the cloth by the friction or rubber covered roll during the entire build of the cloth roll. Furthermore, since it is necessary to raise the hold down arm to remove the cloth during a doffing operation, control means which may be actuated by movement of the hold down arm during the build of the cloth roll have been limited in their controlling function during at least a portion of the build.

Accordingly, it is an important object of this invention to provide a cloth takeup having a friction roll applying tension to the cloth at the point of winding the cloth upon the takeup roll and for controlling tension from the friction roll back to the loom. By controlling the tension exerted by the friction roll during the build a uniform tight cloth roll is produced.

Another important object of the invention is to provide a cloth takeup producing a tight roll especially suitable for fiberglass fabric and fabrics constructed of carbon yarn and the like so as to avoid wrinkles and variations in tension upon the cloth throughout the build of the roll.

Still another important object of the invention is the provision of a hold down device for winding cloth affording full roll tension control during the entire build of the cloth roll.

Another important object of the invention is the provision of a center wound cloth roll takeup utilizing a hold down roll exerting controlled tension where the cloth is being wound and a compensator roll for controlling tension back to the loom.

Another important object of the invention is avoiding the overhauling of the friction roll or slippage thereof on the cloth roll during winding of a center wound roll by providing a regenerative DC drive operable responsive to a roll moved responsive to tension in the cloth before reaching the friction roll.

A further important object of the invention is the provision of a control apparatus including circuitry imparting a speed load characteristic to a center wound roll drive which is compatible with the variation in tension occurring during the build of a center wound cloth roll and the like.

SUMMARY OF THE INVENTION

It has been found that a center wound cloth roll takeup having hold down arms and the like may be provided with a compensator roll for controlling the tension on the cloth from the hold down mechanism back to the loom. A tight roll may be wound since a motor driven friction roll may be provided having a second tension control, independent of the motor driving the takeup roll, which exerts full roll tension control during the build by a second control actuated by a hold down arm as it engages the periphery of the cloth roll during the building operation. The hold down arm moves a pivoted lever downwardly during the build so as to permit the hold down arm to be raised beyond its operating stroke upon completion of the build for doffing the cloth roll without interference with the controls for the hold down arm during the building motion.

A torque may be applied to the friction roll utilizing a regenerative DC drive to avoid slippage between the friction roll and the cloth during the build. A capacitor is provided in series with the motor driving the center wound cloth roll motor imparting a negative slope to the speed load characteristic.

BRIEF DESCRIPTION OF THE DRAWING

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figures 1, 2:
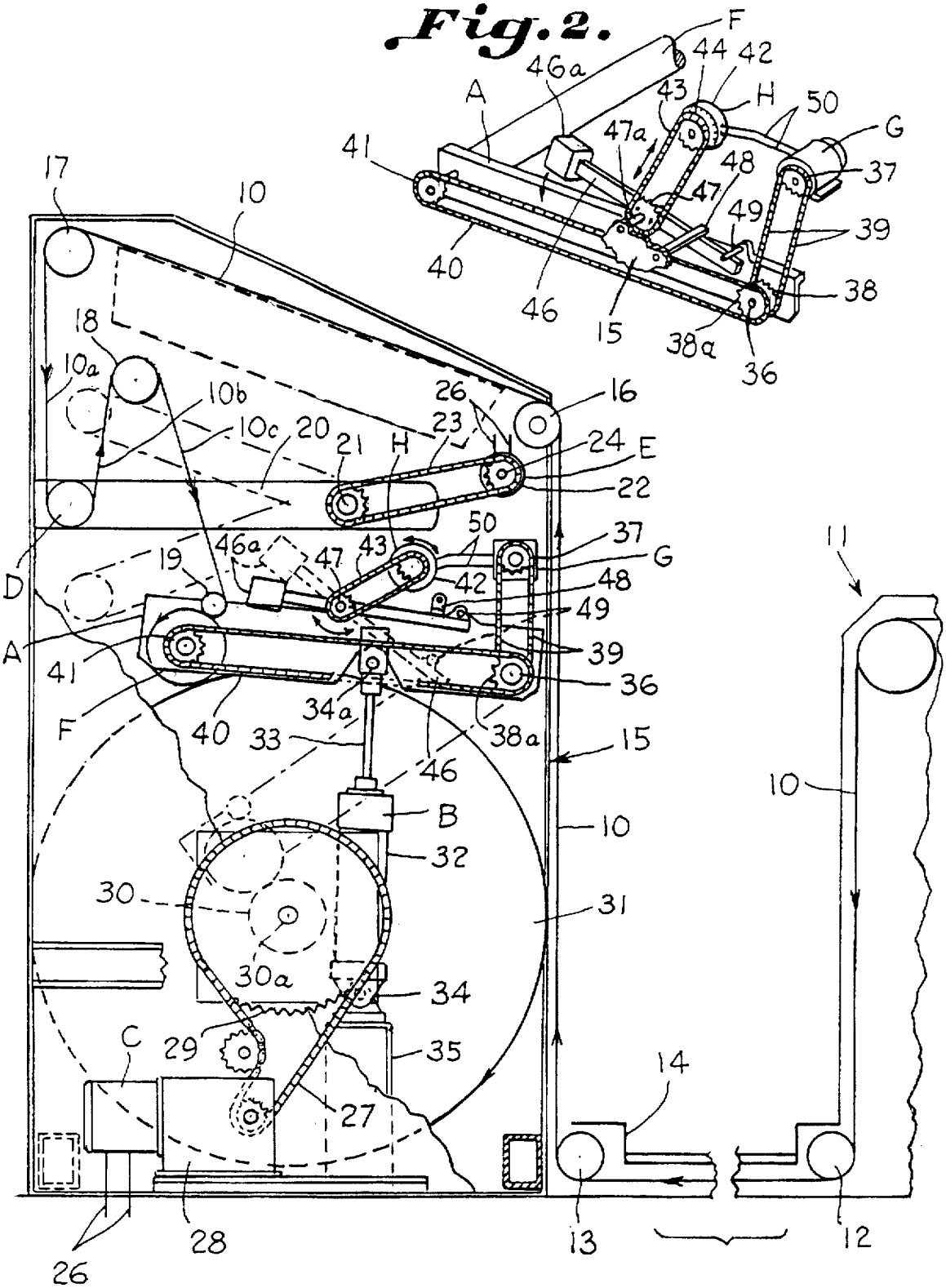
FIG. 1 is a side elevation illustrating a center wind takeup having first and second control devices for respectively controlling tension between a friction roll and the loom, and tension exerted by the friction roll upon the cloth during the build.
FIG. 2 is a perspective view illustrating a control mechanism for varying the drive of the friction roll during the build with means for disengaging same during doffing of the cloth roll.
Figure 3:
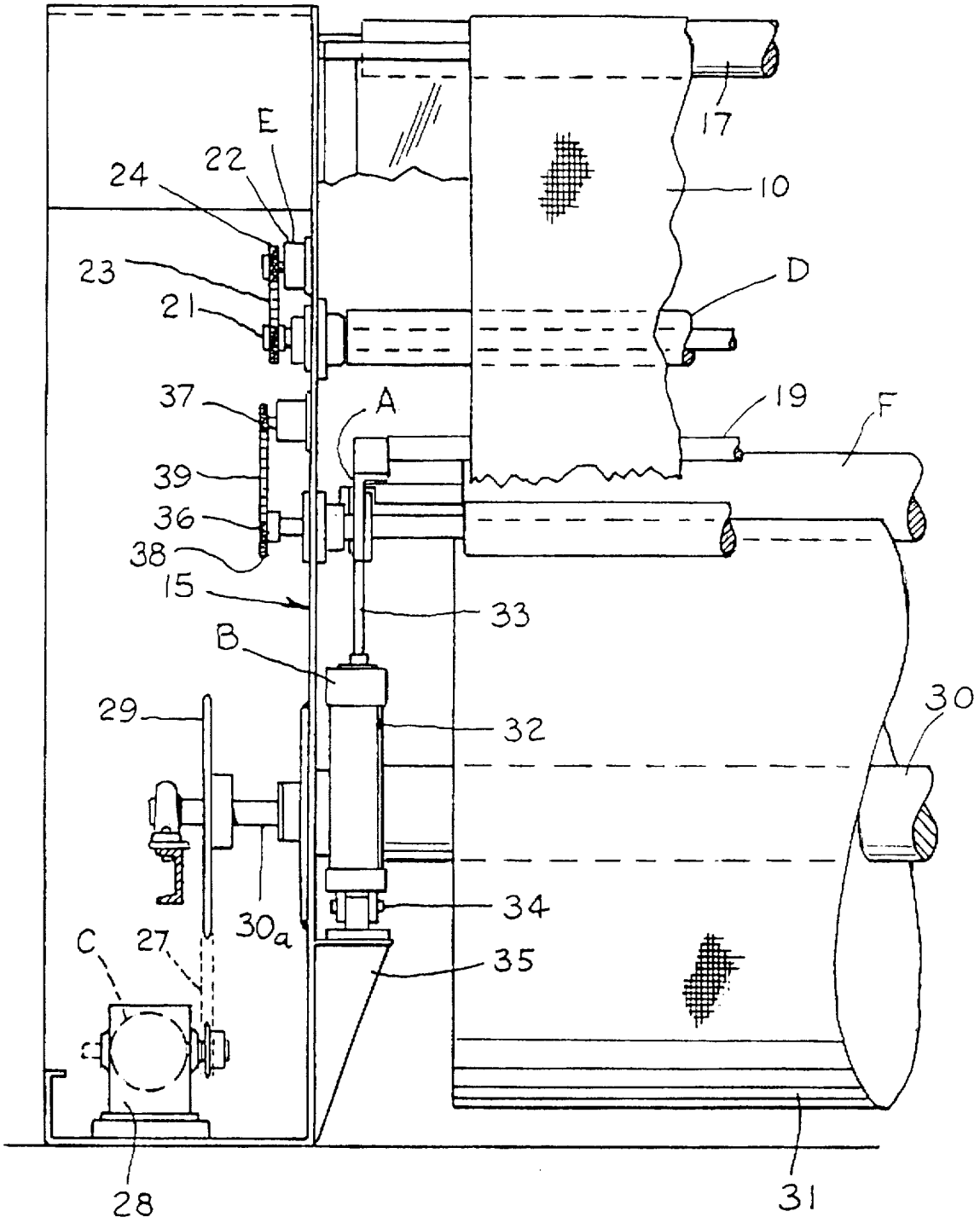
FIG. 3 is a front elevation illustrating drive mechanism for the cloth roll which is controlled to establish a desired limited tension between a friction roll and the loom in response to a compensator roll, together with the positioning of the friction roll controlling the tension exerted upon the cloth at the point of winding upon the roll during the build of the cloth roll.

The drawings illustrate a loom cloth takeup having a center wound roll receiving cloth from a loom and building a cloth roll. A pivotally mounted arm A carries a friction roll F engaging the cloth as it is wound on the center wound cloth roll. An extensible power operated means B exerts a force urging the friction roll into proper position to exert tension upon the cloth. A first motor C exerts a force driving the center wound roll. A tension control roll such as the compensator roll D is supported by the cloth passing thereover moved responsive to variations in tension in the cloth occurring between the loom and the friction roll. In FIGS. 1–3 a first control device E varies the output of the motor C and the resulting tension on the cloth. The friction roll F carried by the arms A is driven by the motor G applying tension to the cloth as it is wound on the cloth roll. A second control device H varies the tension applied by the friction roll to the cloth.

Figure 4:
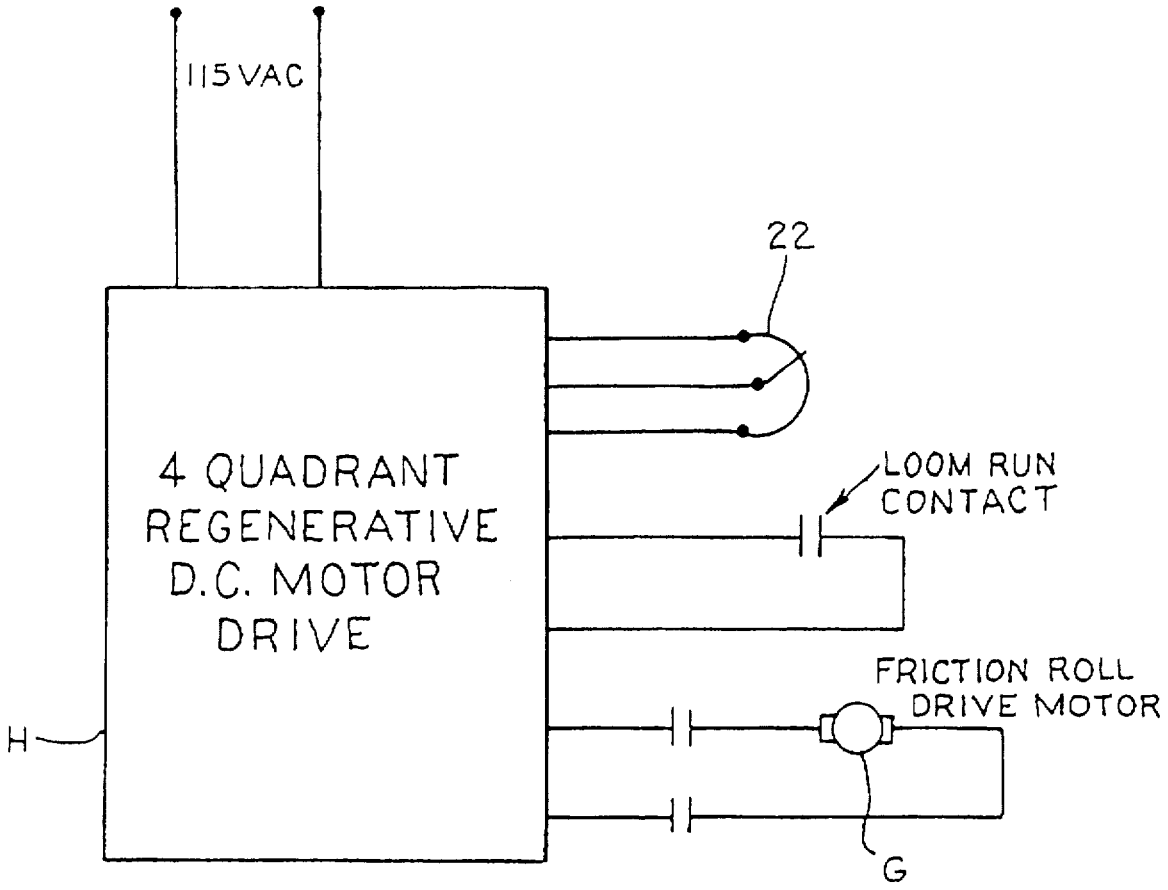
FIG. 4 is a circuit diagram illustrating apparatus for avoiding overhauling or slippage of the friction roll on the cloth as it is wound constructed in accordance with the invention hereof.
Figure 5:
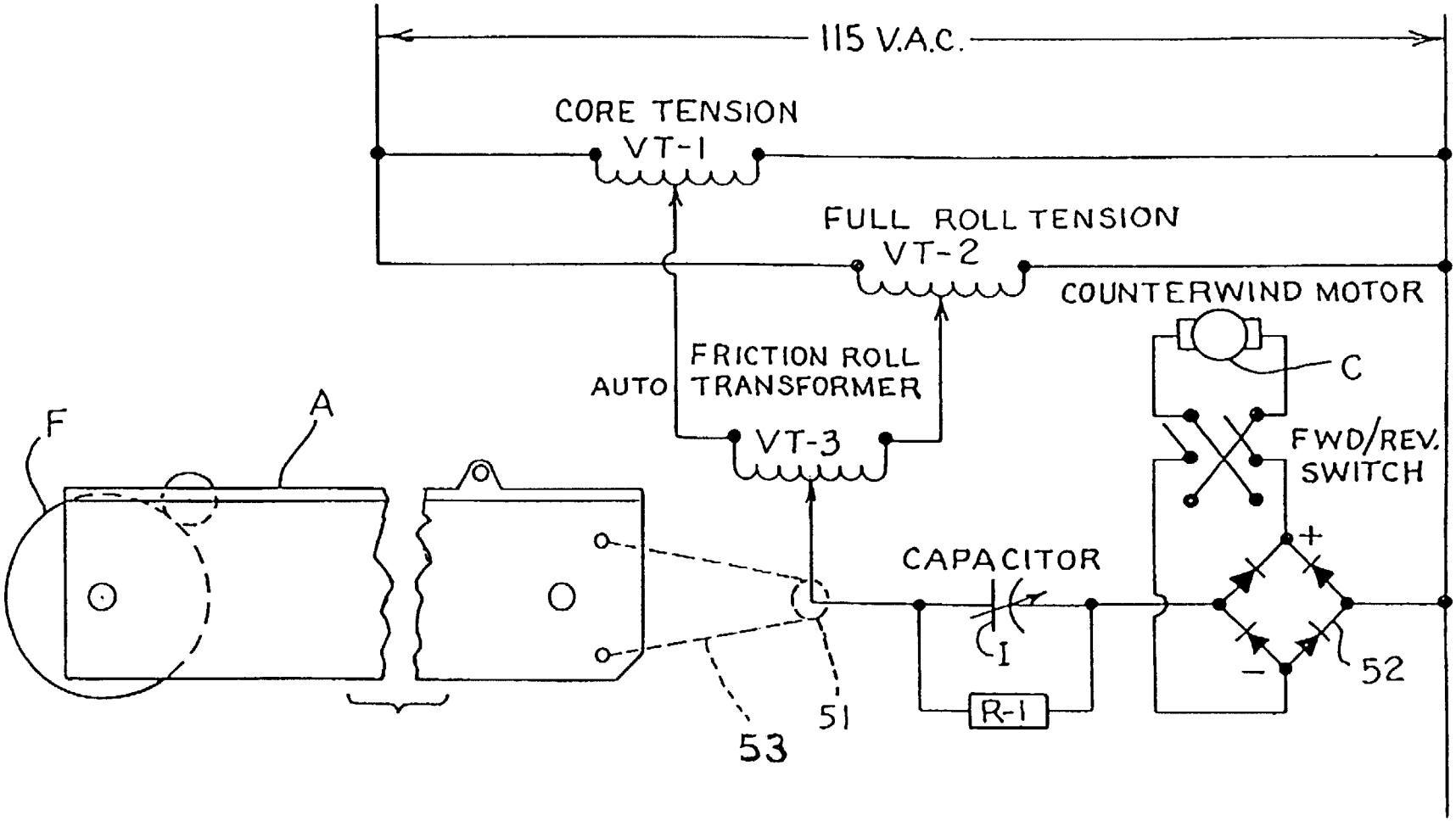
FIG. 5 is a circuit diagram illustrating improved apparatus for controlling the drive of the friction roll responsive to movement of the friction roll during the build in accordance with the invention.

In the improved control of FIGS. 4 and 5 the motor G driving the friction roll F is controlled through a regenerative DC motor drive H responsive to the tension control roll D. Movement of the pivoted arm A controls the motor C driving the center wound roll through a circuit having a capacitor I in series with the motor C.

Referring more particularly to FIG. 1, the cloth 10 is illustrated as being woven upon a loom broadly designated at 11. The cloth 10 passes downwardly over direction rolls 12 and 13 to be carried beneath the weaver's platform 14. The cloth takeup is illustrated as having a frame member broadly designated at 15 which carries the rolls and the various components described herein. The cloth 10 is illustrated as passing upwardly across the rear of the frame over a direction roll 16 and thence forwardly over a suitable direction roll 17 prior to a downward run 10a of the cloth 10 prior to passing over the movable compensator or other tension control roll D from which the cloth passes in an upwardly run lob and over a direction roll 18 and thence downwardly over a roll 19 in a downwardly run **10*c*** to a movable friction roll F which is carried by the hold down arm A.

The compensator roll D is illustrated as being carried by a pivoted arm 20, but it may take the form of a dancer roll carried for vertical movement. The compensator roll may be of the type further illustrated in U.S. Pat. No. 4,216,804. The pivoted arm 20 is secured for pivotal motion at 21 upon the frame 15.

The first control device E includes a potentiometer 22 which is actuated by any suitable drive means such as the chain 23 which passes over a sprocket 24 turned responsive to the oscillations of the arm 20 for controlling the output of the potentiometer.

The output from the potentiometer drives the motor C as through suitable control circuitry (not shown) interposed between the leads 26. The motor drives a chain 27 through a suitable gear box 28 for driving a sprocket 29 for controlling the winding action of the core 30 carried by the shaft **30*a* which carries the web takeup roll 31**.

It will be observed that the hold down arm A exerts a constant force against the cloth 10 through the extensible device B which may be provided in the form of a fluid, preferably air, operated cylinder 32 having a piston rod 33 or a linear force actuator or the like and may be utilized to exert the force applying pressure through the friction roll F against the cloth adjacent the point of winding. The cylinder 32 is carried by a pivotal mounting 34 carried upon a stand 35. The force applied by the cylinder may actually be in most instances an upward force to maintain the friction roll F slightly above and adjacent the cloth roll so that the force exerted thereby is preferably a simple friction hold back or braking action. However, the arms A will be referred to, as usual, as hold down arms although they may provide an upward force on the friction hold down roll F.

The hold down arms A are illustrated as being pivotally mounted at 36 upon the frame 15. A second motor G drives the friction roll F through a suitable drive mechanism which is illustrated as including sprockets 37 and 38 and a chain 39. The sprocket **38*a* through a chain 40 drives a sprocket 41 for controlling and varying the speed and hence the tension applied by the friction roll F to the cloth 10 as it is wound upon the center wound takeup roll 31**. The friction roll is driven by the cloth in a direction opposite to the direction of rotation of the cloth roll. The motor tends to drive the friction roll in a direction opposite to the driving force exerted by the cloth so that the friction exerts a braking action tensioning the cloth as it is wound. The cloth drives the friction roll F against the force exerted by the motor. The friction of the surface of the roll F against the cloth is not overcome during winding.

A second control device H includes a potentiometer 42 actuated by a chain 43 the ends of which are suitably positioned upon sprockets 44 and 47. The sprocket 47 best shown in FIG. 2 is rotated by a link 46 which is pivoted centrally of the sprocket 47 on the stub shaft **47*a* (FIG. 2). One end of the link 46 is biased upwardly toward a stop member 48 carried by the frame 15 and is depressed by a control member 49 carried by the arms A during movement as a result of the build of the cloth roll. The link 46, which acts as a control arm, has a weight 46*a* biasing the other end of the link downwardly. The potentiometer 42 of the control device H controls the second motor G through suitable control circuitry (not shown) interposed between the leads 50**.

It is thus seen that a cloth takeup has been provided which is especially suitable for building tight cloth rolls. The tension on the cloth or other web is controlled ahead of the friction roll F between it and the loom 11 through a suitable compensator roll and the like while full roll tension control is exerted during the build by a constantly varying drive device exerted upon the friction roll. While the hold down or friction roll may desirably be positioned under the control of the hold down arms responsive to the power operated means B during the building operation so as to float against the cloth being wound on the cloth roll, in some instances it may be necessary to apply holddown pressure during a particular application. Since the adjacent hold down arm prevents upward movement of the end of the link 46 remote from the weight during the build and prior to engagement by the stop 48, the hold down arm may be freely pivoted upwardly for doffing of the cloth roll after engagement of the link with the stop 48 without interfering with the control exerted by the link upon the second motor G.

An improved control apparatus and method is illustrated in FIGS. 4 and 5. The problem of overhauling wherein the brake roll, which is used to control the line speed and control tension between the loom and brake roll, slips on the cloth as it is wound on the cloth roll is alleviated by providing a four-quadrant DC motor regenerative drive H. The regenerative drive controls both the driving of the friction roll F as well as overhauling by applying reverse driving torque to the friction roll drive motor G responsive to the potentiometer 22 driven by the compensator tension control roll D.

The normal torque taper of the modified drive hereof operates well with a center driven cloth roll because the speed load characteristics as described in U.S. Pat. No. 3,221,237 relative to the circuit shown in FIG. 5 are compatible with the tension variations occurring during the build. A capacitor I in parallel with resistor R-1 is provided in series with the motor C to impart a negative slope to the speed load characteristic compatible with tension variations during the build. The autotransformers VT-1 and VT-2 on the center wind schematic set both the core tension and full roll tension. In addition this allows adjustable taper during winding by adjusting either autotransformer V-1 or V-2. Autotransformer VT-3 is shown schematically in FIG. 5 driven by the pivoted friction roll arm A through a drive chain 53 which drives the sprocket 51 and moves to the full roll tension autotransformer VT-2. The capacitor is in series with the full wave rectifier 52.

Tension and taper can be varied by adjusting VT-1 and VT-2. Both may be set for the same tension level at core and full roll, or the core may be adjusted for 50% and the full roll for 30% to give additional taper. In most cases tension is set to be the same 50% core and 50% full roll.

While a preferred embodiment of the invention has been described using specific terms, such description is for illustrative purposes only, and it is to be understood that changes and variations may be made without departing from the spirit or scope of the following claims.

What is claimed is:

1. Tension control apparatus for a center wound cloth roll comprising:

a first motor driving said center wound cloth roll;

a friction roll engaging said cloth as it is wound on said center wound cloth roll;

a second motor driving said friction roll;

a tension control roll engaged by said cloth moving toward said friction roll providing a signal responsive to variations in tension in said cloth;

means controlling said first motor driving said center wound cloth roll independently of said friction roll responsive to said signal; and means applying a torque to said second motor driving said friction roll to avoid slippage between said friction roll and said cloth during the build of the cloth roll.

2. The structure set forth in claim 1 including a capacitor in series with said motor driving said cloth roll imparting a negative slope to the speed load characteristic.

3. The structure set forth in claim 2 including a core tension autotransformer for setting initial web tension at the beginning of a winding operation in parallel with a roll tension autotransformer for setting web tension for later stages of said winding operation, and a friction roll autotransformer controlling said first mentioned transformers responsive to a signal resulting from movement of said friction roll during the build of the cloth roll moving progressively to a predetermined tension during said winding operation.

4. The structure set forth in claim 1 wherein said means is a four-quadrant regenerative D.C. drive applying a reverse driving torque to said motor driving said friction roll.

5. Tension control apparatus for a center wound cloth roll comprising:

a first motor driving said center wound cloth roll;

a friction roll engaging said cloth as it is wound on said center wound cloth roll movable with the build of said cloth roll;

a second motor driving said friction roll independently of said center wound cloth roll;

a capacitor in series with said first motor driving said cloth roll imparting a negative slope to the speed load characteristic.

6. The structure set forth in claim 5 including a core tension autotransformer for setting initial web tension at the beginning of a winding operation in parallel with a roll tension autotransformer for setting web tension for later stages of said winding operation, and a friction roll autotransformer controlling said first mentioned transformers responsive to a signal resulting from movement of said friction roll during the build of said cloth roll moving progressively toward a predetermined tension during said winding operation.

7. The method of controlling the tension on cloth wound upon a center wound cloth roll comprising the steps of:

providing a motor driving said center wound cloth roll;

engaging said cloth as it is wound on said center wound cloth roll by a friction roll movable with the build of said cloth roll;

providing a motor driving said friction roll;

mounting a tension control roll for engagement by said cloth moving toward said friction roll providing a signal responsive to variations in tension in said cloth;

controlling said motor driving said friction roll responsive to said signal; and applying a reverse driving torque to said motor driving said friction roll to avoid slippage between said friction roll and said cloth during the build of the cloth roll.

8. The method of controlling tension on cloth wound upon a center wound cloth roll comprising the steps of:

providing a motor driving said center wound cloth roll;

engaging said cloth as it is wound on said center wound cloth roll by a driven friction roll;

utilizing a tension control roll to engage said cloth moving toward said friction roll providing a signal responsive to variations in tension in said cloth controlling said driven center wound cloth roll independently of said friction roll; and imparting a negative slope to the speed load characteristic of said motor controlling said center wound cloth roll.

9. The method set forth in claim 8 including the steps of providing a core tension autotransformer for setting initial web tension at the beginning of a winding operation in parallel with a roll tension autotransformer for setting web tension for later stages of said winding operation, and controlling said transformers by utilizing a friction roll transformer to send said signal resulting from movement of said friction roll during the build of said cloth roll moving progressively toward a predetermined tension during said winding operation.

* * * * *